United States Patent [19]

Rankin

[11] Patent Number: 4,884,632

[45] **Date of Patent: * Dec. 5, 1989**

[54] SIDE ENTRY SUB WELL LOGGING APPARATUS AND METHOD

[75] Inventor: Emmitt E. Rankin, Fort Worth, Tex.

[73] Assignee: Halliburton Logging Services, Inc., Houston, Tex.

[ * ] Notice: The portion of the term of this patent subsequent to Jul. 7, 2004 has been disclaimed.

[21] Appl. No.: 216,580

[22] Filed: Jul. 6, 1988

Related U.S. Application Data

[60] Division of Ser. No. 69,289, Jul. 1, 1987, Pat. No. 4,790,377, which is a division of Ser. No. 837,383, Mar. 7, 1986, Pat. No. 4,678,038, Continuation of Ser. No. 69,289, Jul. 1, 1987, Pat. No. 4,790,377.

[51] Int. Cl.[4] ..... E21B 17/046

[52] U.S. Cl. ..... 166/65.1; 166/301; 166/319; 285/18

[58] Field of Search ..... 166/277, 242, 301, 385, 166/65.1, 66, 319, 321; 285/18, 314, 318, 315, 920, 922; 175/45, 50, 40, 104, 105

[56] References Cited

U.S. PATENT DOCUMENTS

| | | | |
|---|---|---|---|
| 4,200,297 | 4/1980 | Tricon | 166/65.1 |
| 4,232,888 | 11/1980 | Amancharla | 285/18 |
| 4,388,969 | 6/1983 | Marshall et al. | 166/65.1 |
| 4,449,736 | 5/1984 | Blackwell | 285/315 |
| 4,506,729 | 3/1985 | Davis, Jr. et al. | 166/242 |
| 4,524,834 | 6/1985 | Barron et al. | 166/65.1 |
| 4,603,578 | 8/1986 | Stoltz | 166/242 |
| 4,607,693 | 8/1986 | Richardson | 166/65.1 |
| 4,678,038 | 7/1987 | Rankin | 166/65.1 |
| 4,699,216 | 10/1987 | Rankin | 166/65.1 |

*Primary Examiner*—Bruce M. Kisliuk

*Attorney, Agent, or Firm*—William J. Beard

[57] ABSTRACT

A side entry sub logging system has features for removing the cable should the drill pipe become stuck. A release sub is connected between the drill pipe and the side entry sub. A mandrel is carried in the side entry sub and extends into the release sub. Logging cable which passes through the side entry sub sidewall passage also passes through a passage in the mandrel. The mandrel will move between upper and lower positions. The connection between the side entry and the release sub will release when contacted by the mandrel in the lower position. This enables the side entry sub to be pulled straight upward, bringing along with it the cable. A plug dropped into the drill pipe from the surface blocks the passage through the mandrel, enabling fluid pressure to be applied to push the mandrel downwardly to actuate the connection between the release sub and the side entry sub.

2 Claims, 3 Drawing Sheets

SIDE ENTRY SUB WELL LOGGING APPARATUS AND METHOD

This is a divisional of application Ser. No. 069,289 filed July 1, 1987, now U.S. Pat. No. 4,790,377, which is a divisional of application No. 837,383 filed Mar. 7, 1986, now U.S. Pat. No. 4,678,038.

BACKGROUND OF THE INVENTION

Description of the Prior Art:

Most oil and gas wells being drilled are logged at least once during the drilling. In conventional logging, the drill pipe will be pulled, and one or more instruments are lowered on conductor cable into the open hole to measure earth formation characteristics.

Deviated wells that may incline up to 65 degrees or more are common, particularly at offshore locations. A number of wells may be drilled from a single platform. These wells present difficult problems for logging. The logging instrument may not be able to reach bottom due to the inclination. Also, the cable dragging against the curved portion of the well may create a slot or key, causing the instrument to become stuck.

A recent technique has been developed to log deviated wells. In this technique, when it is desired to log a portion of the well, the drill pipe is pulled. The logging instruments are located in special housings and secured to the lower end of the drill pipe. The drill pipe is then run into the well until it is located near the upper end of the zone to be logged. Then, a side entry sub is secured to the upper end of the drill pipe. The side entry sub has a passage extending through its sidewall for cable to pass. A latch is threaded through the sidewall passage, and a packing is placed around the sidewall passage. The latch is pumped down with drilling fluid pressure into electrical engagement with the instruments at the bottom of the well. The cable is placed under tension, and a clamp clamps the cable to the side entry sub.

The string is then lowered farther into the well. Normally, tie wraps will be used to secure the cable to the exterior of the drill pipe as the string is lowered into the well. When the bottom of the well is reached, the side entry sub may be several thousand feet below the surface, but it will still be located in casing.

To log the well, the drill string is then pulled upward. The instruments are energized while each stand is pulled to log the well. The cable at the surface is simultaneously taken up. When the side entry sub again reaches the surface, the clamp is removed and tension is applied to the cable to cause the latch to release from its connection to the logging instruments. The cable is then pulled from the drill pipe and the drill string is then removed normally.

Serious problems occur if the drill pipe becomes stuck in the well while the logging cable is in the drill pipe. The clamp is of a shear release type. However, due to the friction between the cable and drill pipe, and the tie wraps, the clamp may not shear as required. Excessive pulling on the cable may result in it parting at a point above the clamp. A chemical cutter or a jet charge can be lowered into the drill pipe to cut the cable, but it can be cut only at the side entry sub. This still leaves the cable in the drill pipe below the side entry sub.

With the cable in the drill pipe, a stuck point indicator can't be lowered into the drill pipe to indicate where the pipe is stuck. A backoff tool can't be lowered into the drill pipe to back off the drill pipe. There is a possibility that the well would have to be abandoned with the drill string in the well.

SUMMARY OF THE INVENTION

In this invention, an apparatus and a method are provided to enable the cable to be pulled from the drill pipe if the drill pipe becomes stuck while side entry sub logging is taking place. A release sub is connected between the side entry sub and the drill pipe. This release sub has a latch means that when actuated allows the side entry sub to be pulled straight upward, without rotation, from the release sub.

A tubular mandrel is carried in the side entry sub. It extends from a point above the sidewall passage downwardly into the release sub. The mandrel will move between upper and lower positions. The mandrel has a seat on its upper end that is adapted to receive a plug dropped from the surface. The plug seals the axial passage of the mandrel, causing fluid to push the mandrel downward to the lower position. In the lower position, it actuates the release sub latch means to release the connection between the side entry sub and the release sub. The drill string above the release sub can then be picked up, with the latch releasing at the logging instrument.

DESCRIPTION OF THE PREFERRED EMBODIMENT

Figure 1:
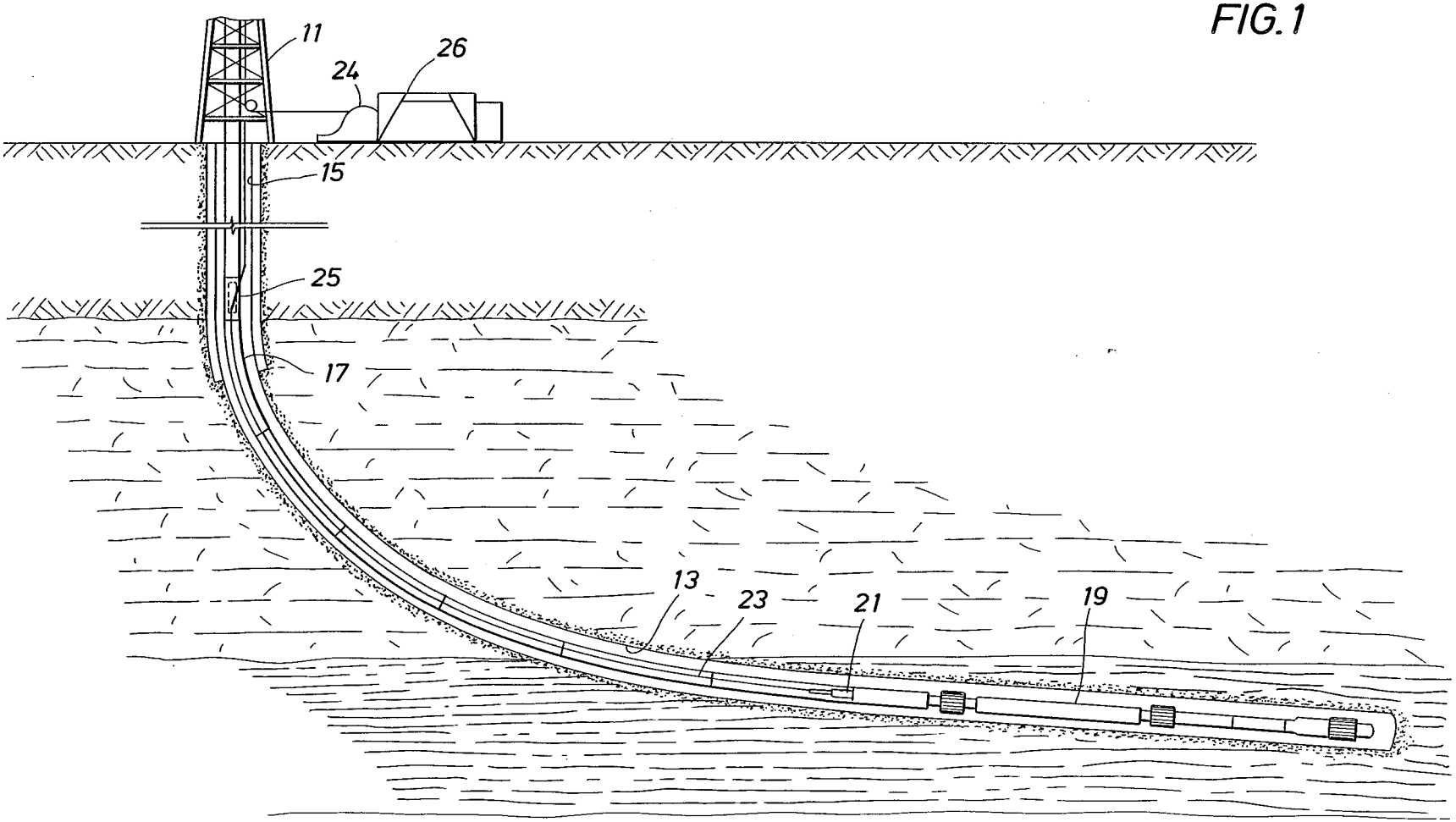
FIG. 1 is a schematic side view illustrating a side entry sub logging system.

Referring to FIG. 1, drilling rig 11 is shown located above a well 13. Casing 15 extends into the well to a selected depth. A string of drill pipe 17 has drilled the well to a greater depth than the casing 15, and the well has been deviated at a high angle.

In the side entry sub logging system, logging instruments 19 located within housings are secured to the lower end of the drill pipe 17. These logging instruments may be of various types, and would normally include a tool using radioactivity for measuring the density of the earth formations, and an induction electrical tool for measuring resistivity of the formations. The instruments 19 are connected through a conventional latch 21 to cable 23 which extends to the surface. The cable 23 is conductor cable, having at least one insulated conductor for supplying power and passing signals between the instrument and the surface.

The cable 23 passes through a passage in the sidewall of a side entry sub 25 located in the string of drill pipe. The cable 23 passes on the exterior of the drill pipe 17 to the surface. The cable passes over sheaves (not shown) in the drilling rig 11 and is wrapped around a winch 24. A logging unit 26 contains the surface instruments for controlling the winch 24 and monitoring the signals from the instruments 19.

Figure 2A:
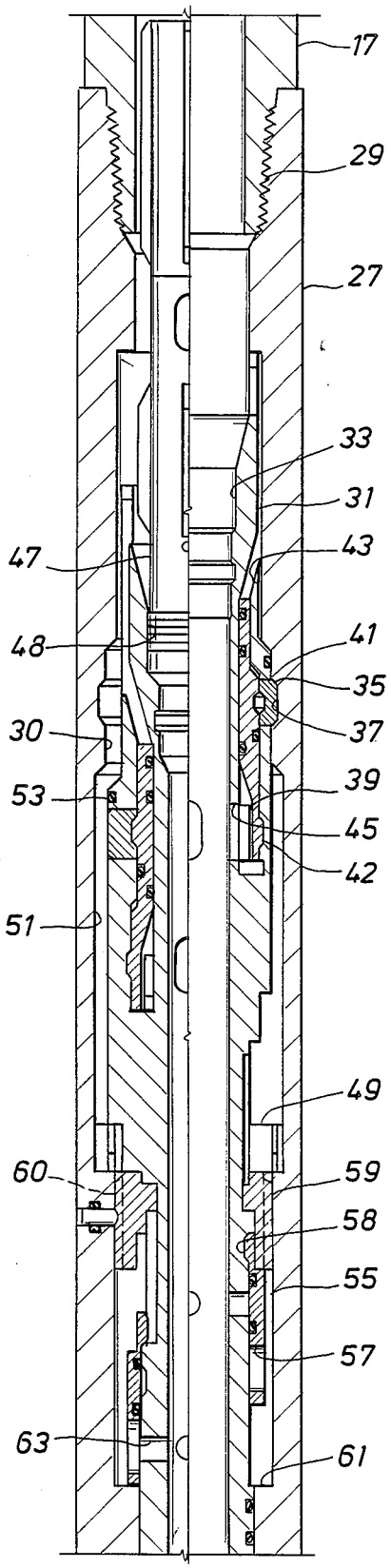
FIGS. 2A, 2B and 2C are simplified cross-sectional views of an apparatus connected into a side entry sub for releasing the side entry sub from the drill pipe.
Figure 2B:
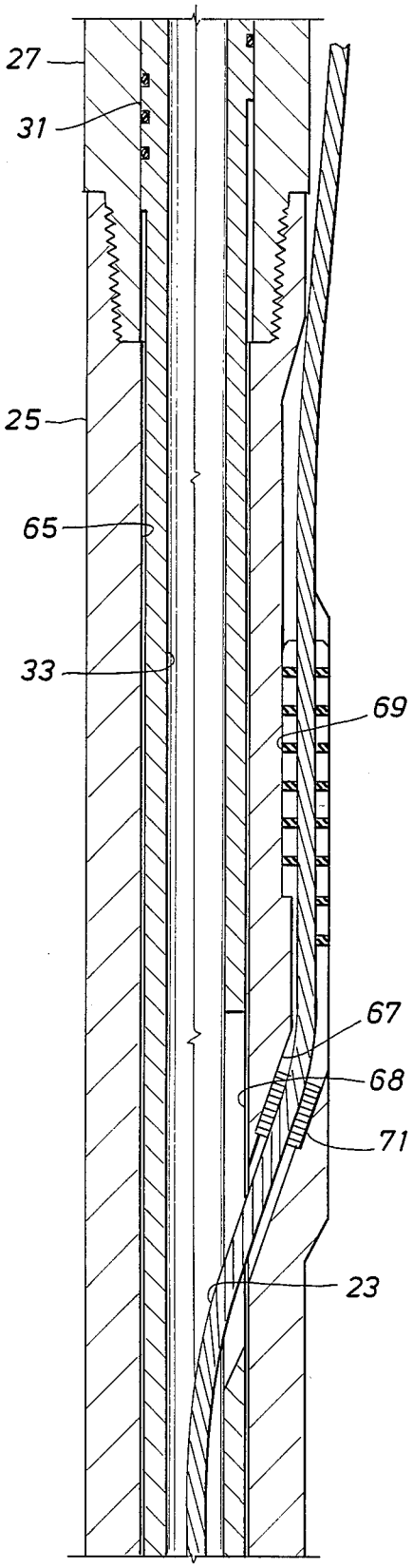
Figure 2C:
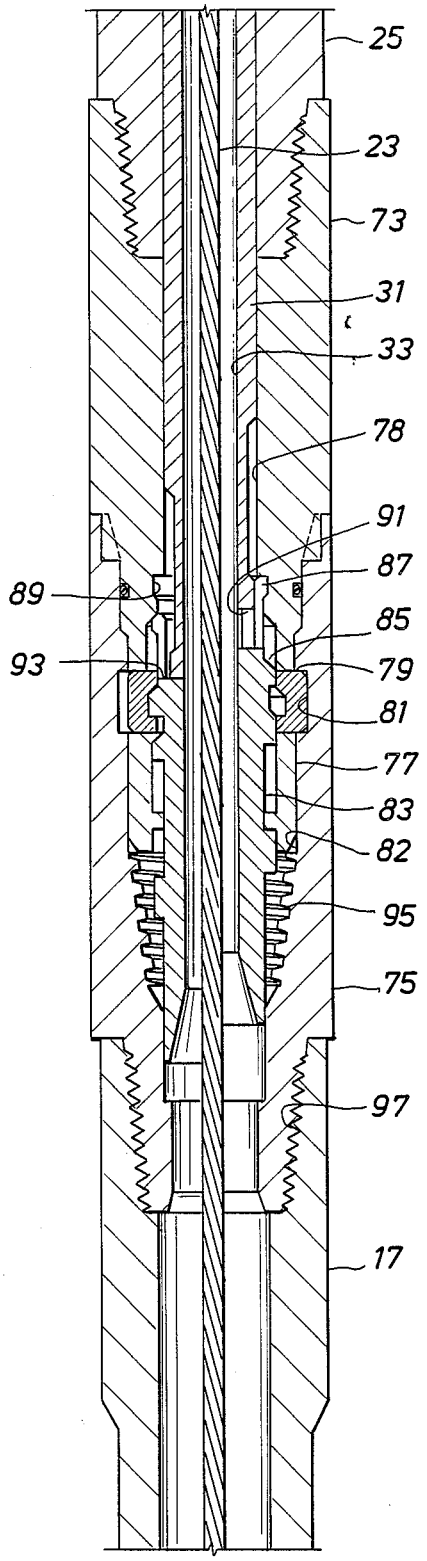

Referring to FIG. 2A, the apparatus in this invention includes an upper tubular housing 27 which is adapted to be connected to the lower threaded end 29 of the drill pipe 17 above the side entry sub 25 (FIG. 1). Upper housing 27 has an axial bore 30 within which a mandrel 31 is carried. Mandrel 31 is tubular having an axial passage 33 that extends completely through its length. Mandrel 31 is moveable between an upper locked position, and a lower release position. FIGS. 2A, 2B and 2C show the locked position on the right-hand side of the drawing, while the released position is shown on the left-hand side of each drawing.

The locking means for holding the mandrel 31 in the locked position includes a plurality of dogs 35. Dogs 35 are carried in apertures in the sidewall of mandrel 31 and are moveable radially between inward and outward positions. In the outward position, the dogs 35 engage a recess 37 formed in the bore 30 of the upper housing 27. This locks the mandrel 31 to the upper housing 27. In the released position, the dogs 35 have moved inwardly, as shown in the left-hand side of FIG. 2A, out of engagement with the recess 37.

The locking means also includes a sleeve 39 which will move between upper and lower positions relative to the mandrel 31. Sleeve 39 is reciprically carried on the exterior of mandrel 31 adjacent the dogs 35. The sleeve 39 has a cam surface 41 which presses outwardly on the dogs 35 to maintain them in the recess 37. When the sleeve 39 is moved downwardly, as shown in the left-hand side of FIG. 2A, the cam surface 41 allows the dogs 35 to retract from the recess 37. This allows the mandrel 31 to be pushed downwardly. Collet fingers 42 located on the lower end of the sleeve 39 engage an annular recess inside mandrel 31 to maintain the sleeve 39 in the upper position with the dogs 35 engaging the recess 37.

The means to move the sleeve 39 from the upper position to the lower position includes a bypass passage 43. Passage 43 is an annular passage leading upward from the upper end of the sleeve 39 to the bore 30 in the upper housing 27 above the mandrel 31. Drilling fluid under pressure in the drill pipe 17 flows around the upper end of the mandrel 31 into the bypass passage 43 and acts against the upper end of the sleeve 39.

An equalizing port 45 extends through the mandrel 31 to communicate the drilling fluid in the axial passage 33 with the lower end of the sleeve 39. If drilling fluid pressure exists in the axial passage 33 of mandrel 31, it will act both on the upper and the lower ends of the sleeve 39. The lower end of the sleeve 39 has a greater cross-sectional or pressure area than the pressure area on the upper end, so that drilling fluid pressure creates a net upward force on sleeve 39, maintaining the sleeve 39 in the upper position.

To move the sleeve 39 to the lower released position, a plug 47 is dropped from the surface. Plug 47 is inserted into the drill pipe 17 at the surface, and either pumped down or allowed to drop down into sealing contact with a seat 48 formed in the upper end of the mandrel 31. Plug 47 blocks drilling fluid pressure in the drill pipe 17 from the axial passage 33 in the mandrel 31.

The drilling fluid flows around the mandrel 31 into the bypass passage 43 to act against the upper end of the sleeve 39. Once the plug 47 is seated on seat 48, there will be no drilling fluid pressure at the equalizing port 45. The drilling fluid pressure in bypass passage 43 causes a downward force on sleeve 33. The collet fingers 42 will release, and the sleeve 39 will move downwardly to the lower position. In the lower position, the dogs 35 move inwardly from the recess 37. This unlocks the mandrel 31. Continued drilling fluid pressure will move the entire mandrel 31 downwardly to the lower position shown in left-hand side of FIG. 2A.

In the lower position, a shoulder of the mandrel 31 will contact a stop 49 located in the housing 27. This limits the downward travel of mandrel 31 in the upper housing 27. A clearance 51 is located around the mandrel 31 below sleeve 39 and above stop 49. When mandrel 31 is in the upper position, drilling fluid pressure in drill pipe 17 is isolated from clearance 51 because of O-ring 53. O-ring 53 is located just above the dogs 35 and seals the exterior of mandrel 31 to the housing 27. However, in the lower position, O-ring 53 will be spaced from the sidewall of bore 30 in upper housing 27, allowing the drilling fluid pressure to enter the clearance 51.

Clearance 51 is part of a circulation passage means which allows drilling fluid to circulate through the mandrel 31 when the side entry sub 25 (FIG. 1) is released from the drill pipe 17 below it, as will be subsequently described. Seal 53 serves as seal means to block flow through the circulation passage means unless the mandrel 31 is in the lower position. The circulation means includes also a sleeve valve 55, shown in FIG. 2A. Sleeve valve 55 sealingly surrounds mandrel 31 below the clearance 51. Sleeve valve 55 has a valve port 57 and collet fingers 58 on its upper end which engage a recess in mandrel 31. Sleeve valve 55 is connected by a shear pin (not shown) to an alignment sub 59 mounted in the bore 30 in upper housing 27. Flow passages 60 extend through the alignment sub 59, and passages also extend through the stop 49 to communicate the fluid pressure that may exist in the clearance 51 to the exterior of the sleeve valve 55.

When mandrel 31 is released and begins moving downwardly, the shear pin will shear. The collet fingers 58 will cause the sleeve valve 55 to move downwardly with the mandrel 31. It moves downwardly until it strikes a shoulder 61 formed in the bore 30 of upper housing 27. Continued downward movement of the mandrel 31 relative to sleeve valve 55 causes the collet fingers 58 to release from mandrel 31. The downward movement of mandrel 31 relative to sleeve valve 55 will align the valve port 57 with a circulation port 63 formed in the sidewall of the mandrel 31. Port 63 communicates drilling fluid flowing on the exterior of mandrel 31 through clearance 51 and passages 60 to the axial passage 33 in the mandrel 31.

Referring to FIG. 2B, the lower end of the upper housing 27 is secured to the upper end of the side entry sub 25. Side entry sub 25 is conventional, having an axial passage 65 extending through it. The mandrel 31 extends completely through the passage 65. A sidewall passage 67 inclines into the axial passage 65 from the exterior. An elongated slot or aperture 68 in mandrel 31 aligns with the sidewall passage 67. Cable 23 extends through this sidewall passage 67 and through the slot 68 into the mandrel axial passage 33. A shear release clamp 69 is used to clamp the cable 23 in tension after the latch 21 has been pumped down into latching engagement with the logging instruments 19 (FIG. 1). A packoff 71 is located in the sidewall passage 67 for sealing the pressure around the cable 23.

Figure 3:
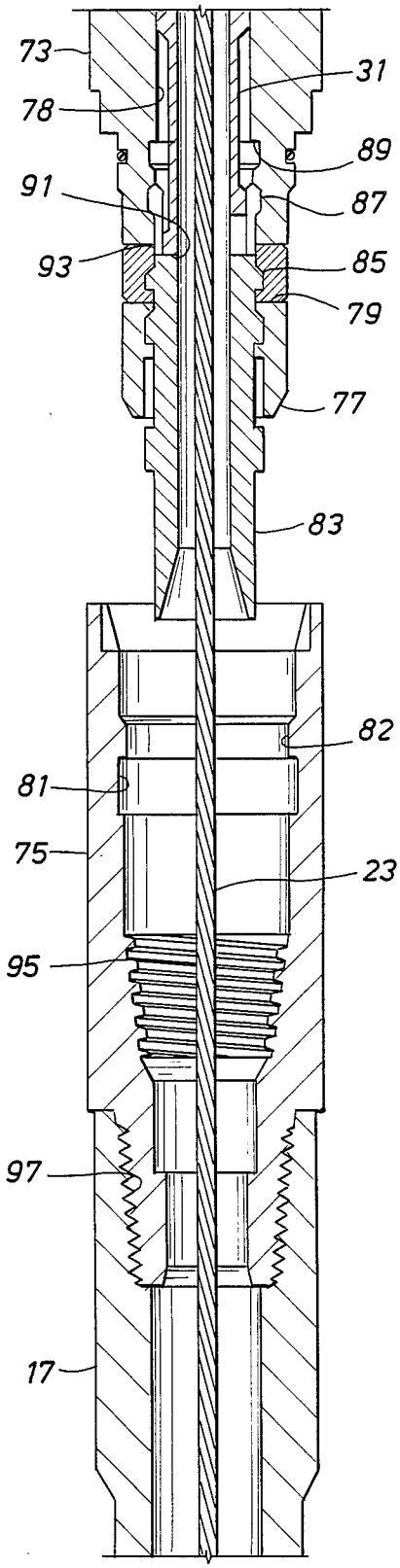
FIG. 3 is a cross-sectional view of the lower portion of the apparatus of FIGS. 2A, 2B and 2C, showing the side entry sub being pulled upward from the drill pipe after releasing.

Referring to FIG. 2C, the lower end of the side entry sub 25 is connected to a lower housing 73. The lower housing 73 can be considered to be the lower end of the side entry sub, and it is connected to a release sub 75. The connection between the lower housing 73 and the release sub 75 is a non-rotary telescoping connection. The lower end 77 of the lower housing 73 extends into the upper end of the release sub 75. The lower housing 73 has an axial bore 78. A plurality of lower dogs 79 are part of a latch means used to lock the release sub 75 to the lower housing 73. The lower dogs 79 are reciprocally mounted in the lower end 77 for radial movement. In the outer position, the dogs 79 engage a recess 81 formed in the bore 82 of the release sub 75. In the released position, the dogs 79 are retracted from the recess 81, as shown in the lefthand side of FIG. 2C. Once retracted, this allows the side entry sub 25 and the lower housing 73 to be pulled upward from the release sub 75, as shown in FIG. 3.

The dogs 79 are moved between the inward and outward positions by means of a tubular latch 83. Latch 83 is carried in the bore 78 of the lower end 77 of the lower housing 73. The latch 83 has on its exterior a cam surface 85. In the upper position, as shown in FIG. 2C, the cam surface 85 maintains the dogs 79 in the outward position engaging recess 81. When latch 83 is moved downwardly to the lower position, shown in the lefthand side of FIG. 2C, the cam surface 85 allows the dogs 79 to move to the inner position out of engagement with the recess 81. The latch 83 has collet fingers 87 on its upper end which engage a recess 89 formed in the bore 78 of the lower housing 73. The collet fingers 87 will release if sufficient downward force is applied by the mandrel lower end 91. The mandrel lower end 91 contacts a shoulder 93 located on the inside of the collet fingers 87.

The release sub 75 has a set of threads 95 formed in its bore 82. Threads 95 allow a fishing tool to be lowered into the release sub 75 after the drill pipe 17 above the release sub 75 has been removed. The release sub 75 is connected to the upper threaded end 97 of the drill pipe 17.

In operation, referring to FIG. 1, when it is desired to log a section of the well, the drill pipe 17 will be pulled from the well. The logging instruments 19 will be connected to the bottom of the drill pipe 17, and the drill pipe will be lowered back into the well. When the drill pipe 17 is located above the zone of interest, a selected distance from the bottom, the release sub 75 (FIG. 2C) with the lower housing 73 is secured to the upper threaded end 97 of the drill pipe 17. The side entry sub 25 is secured to the lower housing 73.

The latch 21 (FIG. 1) is passed through the sidewall passage 67 (FIG. 2B) and the mandrel slot 68. The upper housing 27 is mounted to the top of the side entry sub 25. The packing 71 is placed around the cable 23. The latch 21 (FIG. 1) is pumped down by drilling fluid pressure until it engages the logging instruments 19. Tension is applied by the winch 24 (FIG. 1), and the clamp 69 (FIG. 2B) is secured to hold the cable 23 in tension.

Then the lower end 29 of the drill pipe 17 is secured to the upper housing 27, and the entire string of drill pipe 17 is lowered into the well. When the bottom is reached, side entry sub 25 will still be located in casing 15, but it may be several thousand feet below the surface. Logging is accomplished by pulling the drill pipe 17 upward a stand at a time. The cable 23 above the side entry sub 25 is taken up by the winch 24 as the drill pipe 17 is pulled.

If the drill pipe 17 becomes stuck in the well while the cable 23 is latched to the instruments 19, the side entry sub 25 can be released from the drill pipe 17 located below the side entry sub. This is handled by dropping the plug 47 (FIG. 2A) into the drill pipe 17 from the surface. Drilling mud or fluid pressure is then applied to tightly seat the plug 47 into the seat 48 (FIG. 2A). Once sufficient pressure is reached, the collet fingers 42 will release, and the sleeve 39 will move downwardly relative to the mandrel 31. Dogs 35 will move inwardly from the recess 37, unlocking the mandrel 31 from the housing 27.

The fluid pressure will force the mandrel 31 downwardly. Its lower end 91 (FIG. 2C) will push the latch 83 downwardly, causing dogs 79 to retract from the recess 81. The drill pipe 17 can then be picked up. The lower housing 73 will move upwardly from the release sub 75, as shown in FIG. 3. The latch 21 (FIG. 1) will release from logging instruments 19 as the drill pipe 17 is picked up.

Also, while the mandrel 31 is moving downwardly to its lower position, the sleeve valve 55 (FIG. 2A) shears from the alignment sub 59 and moves downwardly with the mandrel 31. When the sleeve valve 55 reaches the shoulder 61, the collet fingers 58 release from the mandrel 31, allowing the mandrel 31 to move downward relative to sleeve valve 55, aligning port 63 with port 57.

The alignment of ports 63 and 57 allows circulation to occur after the drill pipe 17 has been picked upwardly from the release sub 75, as shown in FIG. 3. The drilling fluid will flow around the mandrel 31, (FIG. 2A), through the clearance 51, through the passages 60, and through the ports 57 and 63. The drilling fluid flows through the axial passage 33 in mandrel 31 and out the lower end to return up the annulus between the casing 15 (FIG. 1) and the drill pipe 17.

The drill pipe 17 is pulled to the surface, with the winch 24 (FIG. 1) retracting the cable 23 as each stand as pulled. When the side entry sub 25 reaches the surface, the clamp 69 is released, and the cable 23 along with the latch 21 is pulled from the drill pipe 17 with winch 24. The drill pipe 17 below the release sub 75 will still be in the well, but all of the cable 23 will be removed.

The drill pipe 17 is again lowered, but with a fishing tool on its end, for engaging the retrieving threads 95 (FIG. 3). Conventional operations are then carried out to attempt to free the drill pipe. This may include the use of jars in the pipe to jar the pipe loose. Also, stuck point indicator instruments can be lowered on cable through the drill pipe to locate the position where the pipe is stuck. A backoff tool could be lowered on a cable through the drill pipe to assist in unscrewing the pipe above the point where it is stuck. There are various other conventional techniques, as well, that can be used, because the drill pipe 17 will not have any cable within it to hinder conventional fishing operations.

The invention has significant advantages. The apparatus allows the side entry sub to be released from the drill pipe, without the risk of breaking the logging cable. The apparatus allows conventional side entry subs to be used. The apparatus allows the release of the side entry sub without cutting the cable.

While the invention has been shown in only one of its forms, it should be apparent to those skilled in the art, that it is not so limited, but is susceptible to various changes without departing from the scope of the invention.

I claim:

1. In a well logging system in which conductor cable extends outside of a drill string assembled of drill pipe and a side entry sub, the cable entering into a sidewall passage of the side entry sub and extending through the drill pipe to a logging instrument located at the lower end of the drill string, an apparatus for releasing the side entry sub from the drill string in the event the drill string becomes stuck, the apparatus comprising:

(a) a release sub having a telescoping joinder means connecting to the drill string below the side entry sub; and (b) means for releasably latching the side entry sub to the release sub serially with the drill string, said latching means releasing the side entry sub from the release sub without rotation to enable the side entry sub to be pulled upwardly from the drill string.

2. An apparatus for connection in a drill string assembled of drill pipe and a side entry sub, the side entry sub having:

(1) upper and lower ends connected by an axial passage for drilling fluid flow along the drill string, (2) a cable entrance thereinto permitting a cable to be positioned in the drill string, the apparatus permitting release of the drill string below the side entry sub and comprising:

(a) a release sub including (1) an upper end, (2) a lower end, (3) a passage between the ends;

(b) telescoping means for joining the release sub to the drill string below the side entry sub;

(c) latch means connected to the lower end of the side entry sub; and (d) said latch means also connected to the upper end of the release sub, said latch means being constructed and arranged to release the release sub in axial relative motion without rotation.

* * * * *